United States Patent [19]

Lloyd

[11] 4,015,905

[45] Apr. 5, 1977

[54] TARGET SIGHTING DEVICE

[75] Inventor: Wayne B. Lloyd, Baltimore, Md.

[73] Assignee: Westinghouse Electric Corporation, Pittsburgh, Pa.

[22] Filed: Feb. 18, 1976

[21] Appl. No.: 658,950

[52] U.S. Cl. ..... 356/248; 33/230; 350/16

[51] Int. Cl.[2] ..... G01C 15/14

[58] Field of Search ..... 356/248, 253, 254, 255, 356/149; 350/10, 16, 310; 33/230

[56] References Cited

UNITED STATES PATENTS

| | | | |
|---|---|---|---|
| 3,471,931 | 10/1969 | Bezu | 356/248 X |
| 3,518,016 | 6/1970 | Burdin et al. | 356/248 |
| 3,522,993 | 8/1970 | Gabriet | 356/248 |

*Primary Examiner*—John K. Corbin
*Assistant Examiner*—Matthew W. Koren
*Attorney, Agent, or Firm*—D. F. Straitiff

[57] ABSTRACT

An improved target sighting device of the type particularly suited for use on moving vehicles, such as military aircraft, and in which a vertically-disposed C-shaped elevation gimbal is supported for rotary movement about an elevation axis at the center of the gimbal to enable a vertically extending mirror on the gimbal to be aimed toward a target along a line of sight at one side of the gimbal, for reflection of target information along such axis and through the open end of the gimbal to a fixed optical pickup assembly. Improvement resides in the support of the open end of the gimbal by a ring bearing encircled by an annular flex pivot assembly that limits the extent of rotary aim-influencing vibration that can be transmitted from the exterior of the device to the gimbal and mirror circumferentially through the ring bearing by friction.

4 Claims, 6 Drawing Figures

TARGET SIGHTING DEVICE

BACKGROUND OF THE INVENTION

1. Field of the Invention

Gimballed-mirror target sighting devices.

2. Description of the Prior Art

Prior art target sighting devices of the type employing a C-shaped-gimbal-supported mirror that directs optical information from a line of target sight to a reflected optical path aimed toward a fixed optical pickup assembly, insofar as applicant is aware, have employed either a cantilevered rotary shaft support at the closed end only of the C-shaped gimbal, or an arrangement including a shaft at such closed end together with a yoke appended to the otherwise open end of the gimbal and a shaft affiliated with the fixed optics assembly. Either of these arrangements can be made to perform well, but each tends to lack either symmetry or rigidity that must be accounted for in the design of the device in order to avoid undesirable aim-influencing mirror movement under influence of a vibratory environment, such as may exist on an aircraft.

SUMMARY OF THE INVENTION

The present invention, in providing ring-bearing rotary support for the open optical-output-path end of the C-shaped elevation gimbal, introduces a rigidity to such gimbal and mirror thereon in a highly-efficient structural manner, while preserving a symmetry about the central axis of the gimbal that discourages inertial creation of torsional moments by rectilinear vibratory movement of the device. At the same time, transmission of rotary vibration of the device about the elevation axis through friction of the relatively large ring bearing is significantly limited by the annular flex pivot assembly that is so constructed as to maintain rigidity with respect to rectilinear or straightline motion.

DESCRIPTION OF THE PREFERRED EMBODIMENT

Figure 1:
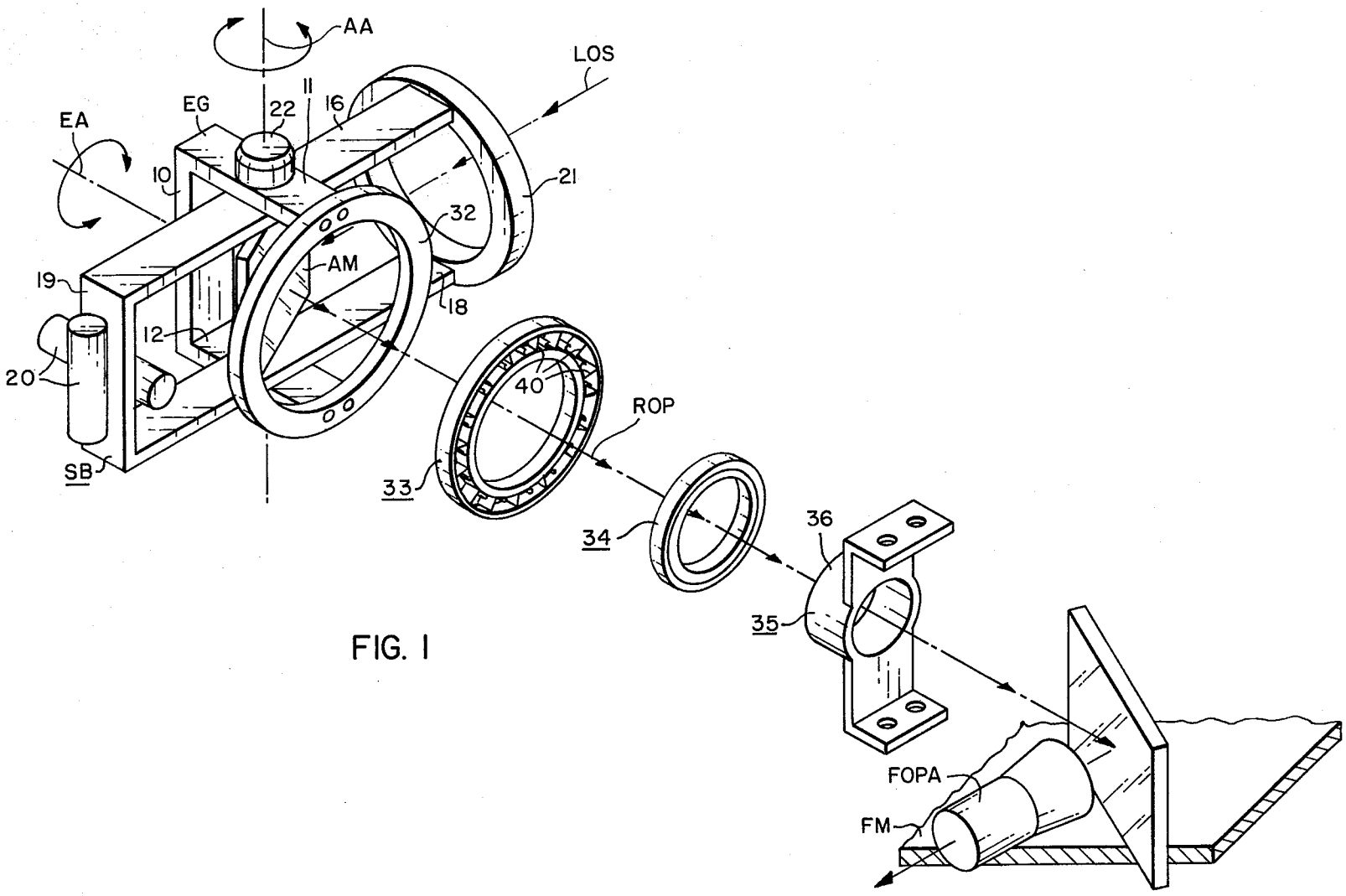
FIG. 1 is a three-dimensional partially-exploded view of pertinent portions of a gimballed-mirror target sighting device embodying the invention.

Referring to FIG. 1, a target sighting device embodying the improvement of the present invention comprises a vertically-disposed C-shaped elevation gimbal EG having a vertical member 10 joining top and bottom horizontal members 11 and 12, respectively. Gimbal EG supports a vertically extending flat aimable mirror AM mounted on vertical stepped aligned stub shafts 14 (FIG. 5) at top and bottom of the mirror. The axis of rotation of the stub shafts 14 coincides with a vertically extending azimuth axis AA that lies in the same vertical plane as the reflective surface of the mirror AM, such as its front face. Although not directly involved with the present invention, the target sighting device in which the invention is embodied also includes a stabilized body SB having vertically separated horizontal members 16 and 18 joined at one end by a vertical end piece 19 carrying horizontal and vertical stabilization gyros 20 and joined at the other and forward end by ring member 21. The stabilized body SB is also carried on the elevation gimbal EG by the stub shafts 14.

Figure 4:
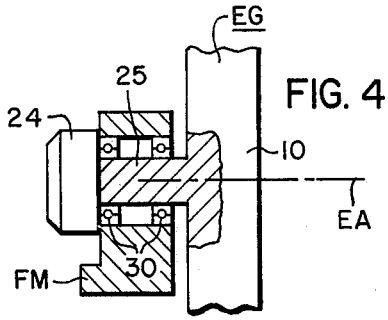
FIG. 4 is a fragmental view of a schematic representation of a small-diameter shaft support for the rear or closed end of the elevation gimbal; and, FIGS. 5A and 5B are fragmental views of schematic representations of typical support and actuating means for aiming the mirror in the target device embodying the present invention.
Figure 5A:
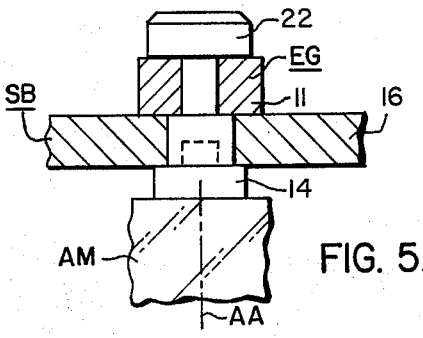
Figure 5B:
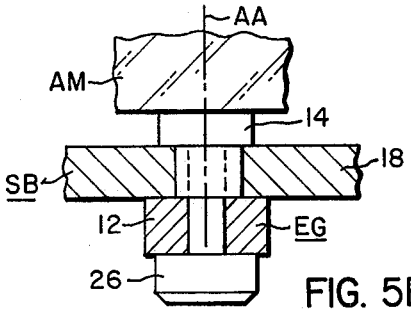

During the usual operation of a target sighting device of this type, the stabilized body SB and elevation gimbal EG will be caused to assume positions substantially as shown in FIG. 1 in which they extend at right angles with respect to one another, with the forward ring end of the stabilized body SB pointed along a line of sight LOS along which it is desired to search for a target (not shown), and with the mirror AM positioned to reflect images arriving from along such line of sight at right angles along a reflected optical path ROP to a fixed optical pickup assembly FOPA. At this time, i.e. during target search, the gyros 20 on stabilized body SB will be inactive to facilitate its angular movement in unison with gimbal EG and mirror AM which are maintained effectively locked together by a control system (not shown), torque motor means 22 for turning the stabilized body SB about the azimuth axis AA relative to the elevation gimbal EG, and a torque motor means 24 (FIG. 4) for turning the elevation gimbal EG about the elevation axis EA relative to a fixed mount FM via a small diameter shaft 25 and bearing means (not shown) affiliated with rear vertical member 10 of elevation gimbal EG. The target sighting device and its parts as thus "locked" together move in unison with the vehicle, airplane for example, on which the device is mounted until a target is picked up along the line of sight LOS. At this time, the gyros 20 and control of the torque motor means 22 and 24 will be effectuated to enable the stabilized body SB to hold an inertial position pointed toward the target while the vehicle, aircraft for example, changes its attitude to a limited extent relative to the line of sight LOS maintained by the stabilized body SB. At this time, any change in attitude of the vehicle relative to the elevation axis EA will not affect aiming of the mirror AM, since it and the elevation gimbal EG will be held against turning about such axis by the stabilized body SB through the medium of the shaft means 14 (FIG. 5). At the same time, a change in angular position of the vehicle relative to the azimuth axis AA results in turning of the elevation gimbal about such axis in correspondence with such vehicle turning, through the medium of the fixed mount FM support for such gimbal. Such elevation gimbal turning occurs relative to the stabilized body SB about the azimuth axis AA and automatically effectuates angular movement of the mirror AM about the same axis to one half the extent that such gimbal turned. This is realized by operation of a half-angle drive means 26 at the bottom of the gimbal EG (FIG. 5) that responds to relative turning movement between the elevation gimbal EG and the stabilized body SB about the azimuth axis AA and is operatively connected to the mirror AM through a system of various sized pulleys and belts, for example, (not shown). Thus, during such limited vehicle maneuvering the mirror AM is automatically adjusted to be maintained aimed toward the target to maintain a target image or optical target information directed toward the fixed optical pickup assembly FOPA.

Referring to FIG. 1, it will be apparent that slight vibratory movement of mirror AM in rectilinear or straightline fashion, perpendicularly of the line of sight LOS or of the azimuth axis AA or of the elevation axis EA, for example, does not tend to smear an image reaching the optical pickup assembly FOPA, it will not tend to cause the mirror to lose sight of the target, since its aim does not tend to be disturbed. On the other hand, angular vibratory disturbance of the mirror about these axes, even slightly, tends to cause jittering degradation of image information.

Accordingly, since symmetry of the elevation gimbal EG as well as its rigidity can affect the nature and extent of undesirable motion of the mirror AM in the presence of vehicle vibration that can be transmitted to the target sighting device via its mount FM, the present invention supports the rear of the elevation gimbal EG via the relatively small diameter shaft 25 (FIG. 4) which can be made to have very little rotary friction by use of small-diameter ball bearing assemblies 30, and supports the front of such gimbal via a rigidizing ring 32 joining the projecting ends of gimbal members 11 and 12, an annular flex pivot assembly 33, a ball-bearing ring bearing 34, and a bracket member 35 for attachment to the fixed mount FM.

Support of the forward end of the elevation gimbal EG by the ring bearing 34 provides for support of such gimbal both fore and aft to afford a high degree of rigidity that tends to be lacking when cantilevered rear support only is employed. Such ring bearing and associated components, in being located at one side of the azimuth axis AA opposite to that of the rear member 10 of gimbal EG, tends to provide inertial balance to the assembly with respect to such axis, while its symmetry with respect to the elevation axis affords a similar balance with respect to the latter axis also. The ring bearing 34 et al is located between the mirror AM and the optical pickup FOPA and located concentrically around the elevation axis and reflected optical path to provide a compact arrangement. The annular flex pivot assembly can be press fit into the inner circumferential edge of the mounting ring 32, the ring bearing 34 can be press fit into the center of such assembly 33, and a boss 36 on bracket member 35 can be press fit into the center of the ring bearing.

The ring bearing 34, while intended to provide low-friction rotary support for the front end of the elevation gimbal EG does include a number of ball bearings 37 interposed radially between the usual annular raceways 38 and 39 which must be proportioned to preload such ball bearings 37 to assure adequate rigidity for the requirements of the device. Since the preloaded bearings 37 are located some considerable radial distance from the axis EA, they tend to create a circumferential friction force relative to any turning effort that may be imposed on the inner bearing raceway 38 by angular vibration introduced via the mount FM and bracket 35. As will be described, the annular flex pivot assembly prevents any such circumferential vibration that may become transmitted through the preloaded ring bearing assembly 34 from undue influence on the elevation gimbal EG and mirror AM, while preserving linear rigidity.

Figure 2:
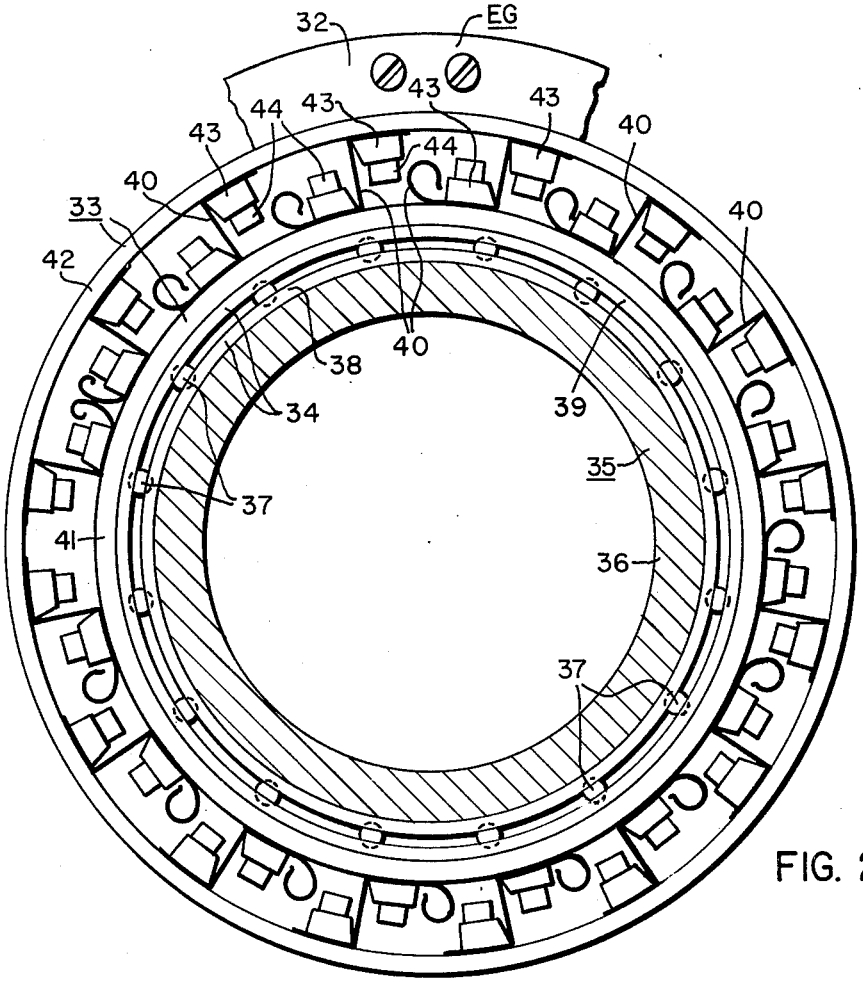
FIG. 2 is a front elevation outline view showing details of an illustrative construction of the ring bearing and annular flex pivot assembly of the present invention in affiliation with a mounting member and in support of the open-ended elevation gimbal.
Figure 3:
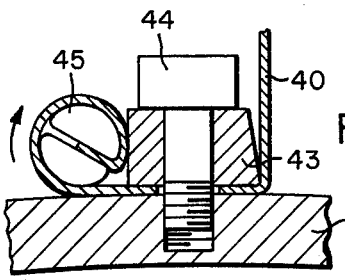
FIG. 3 is a fragmented view, partly in outline and partly in section, of a portion of the flex pivot assembly showing details with respect to its construction.

Referring particularly to FIG. 2, the annular flex pivot assembly 33 comprises a plurality of tensioned metal tape elements 40 extending radially between inner and outer ring members 41 and 42 at circumferentially spaced apart intervals. Opposite ends of the tape elements are bent and held in clamped contact with the inner surface of the ring members 41 and 42 by rounded-edge clamp members 43 retained by machine screws 44. By use of a slotted-end tool 45 (FIG. 3), the free end of each tape element 40 can be gripped and drawn tight by a twisting motion in cooperation with a reaction with a respective clamp member 43 in a partially relaxed state of the respective machine screw 44, such gripping of the free end of the tape member being in the nature of twist-opening of a coffee can by use of a key supplied with the can to remove the annular tab near the upper end of the can. After suitable tensioning, the screw 44 is tightened to secure the clamp 43 for gripping the metal tape element end. A slot in the bent end of the tape element 40, through which the screw can extend, enables such end to be pulled under the clamp member 43 to accommodate such tightening. Each tape element 40 is oriented such that its wider faces extend axially with respect to the assembly to provide rigidity in such direction. As is desired, low amplitude circumferential vibration at the inner ring 41 meets negligible resistance from the tape members 40 which flex at their anchor points at the clamp members 43. Linearly, the array of tensioned tape members 40 are rigid.

In one test configuration, an annular flex pivot assembly constructed to include sixteen steel tape elements 40 each two thousandths of an inch thick and one quarter of an inch long each tensioned at four pounds succeeded in maintaining a stabilization error of the device of less than 10 to 25 microradian deviation in mirror pointing accuracy during subjection of the device to vibrations typical of those currently experienced on fighter aircraft.

I claim:

1. An improved target sighting device comprising, a vertically-disposed elevation gimbal having a horizontal elevation axis extending therethrough, small-diameter shaft means pivotally supporting a rear portion of said gimbal with respect to said elevation axis, large diameter ring bearing means pivotally supporting a forward portion of said gimbal with respect to said elevation axis, a flat mirror pivotally supported on said gimbal about a vertical azimuth axis for aiming target information from one side of said gimbal in a direction along said elevation axis toward the center of said ring bearing means, and an annular flex pivot means interposed between said ring bearing means and said gimbal, said flex pivot means being relatively rigid with respect to transmission of force in straight linear directions and relatively yieldable to a limited extent circumferentially about its central axis.

2. The improved target sighting device of claim 1, wherein said ring bearing means comprises preloaded bearing balls.

3. The improved target sighting device of claim 1, wherein said annular flex pivot means comprises a plurality of tensioned metal tape elements extending radially between coaxial ring members at circumferentially spaced-apart locations therearound.

4. The improved target sighting device of claim 3, wherein flat faces of such tape elements extend in the axialwise direction of said ring members.

* * * * *